US006005457A

United States Patent [19]

Wu

[11] Patent Number: 6,005,457

[45] Date of Patent: Dec. 21, 1999

[54] CIRCULAR WAVEGUIDE CAVITY AND FILTER HAVING AN IRIS WITH AN ECCENTRIC CIRCULAR APERTURE AND A METHOD OF CONSTRUCTION THEREOF

[75] Inventor: Ke-Li Wu, Dundas, Canada

[73] Assignee: Com Dev Ltd., Cambridge, Canada

[21] Appl. No.: 09/007,080

[22] Filed: Jan. 14, 1998

[51] Int. Cl.[6] ..... H01P 1/208

[52] U.S. Cl. ..... 333/208; 333/209; 333/212

[58] Field of Search ..... 333/208, 209, 333/212, 21 R, 21 A, 230

[56] References Cited

U.S. PATENT DOCUMENTS 3,845,415 10/1974 Ando ..... 333/208 X 4,028,651 6/1977 Leetmaa ..... 333/212

4,644,305 2/1987 Tang et al. ..... 333/208

5,821,837 10/1998 Accatino et al. ..... 333/212 X

*Primary Examiner*—Seungsook Ham

*Attorney, Agent, or Firm*—Daryl W. Schnurr

[57] ABSTRACT

A microwave circular waveguide cavity and filter containing said cavity has a circular iris mounted transversely within the cavity. The iris has an eccentrically located circular aperture that is sized and located to control coupling between modes resonating in the cavity. The cavity can be a dual mode cavity, a triple mode cavity or a higher mode cavity. In a method of constructing such a cavity, coupling can be controlled by choosing from a number of variables including the size of the aperture, the offset distance, the inclination angle, the thickness and the location of the iris within the cavity.

23 Claims, 7 Drawing Sheets

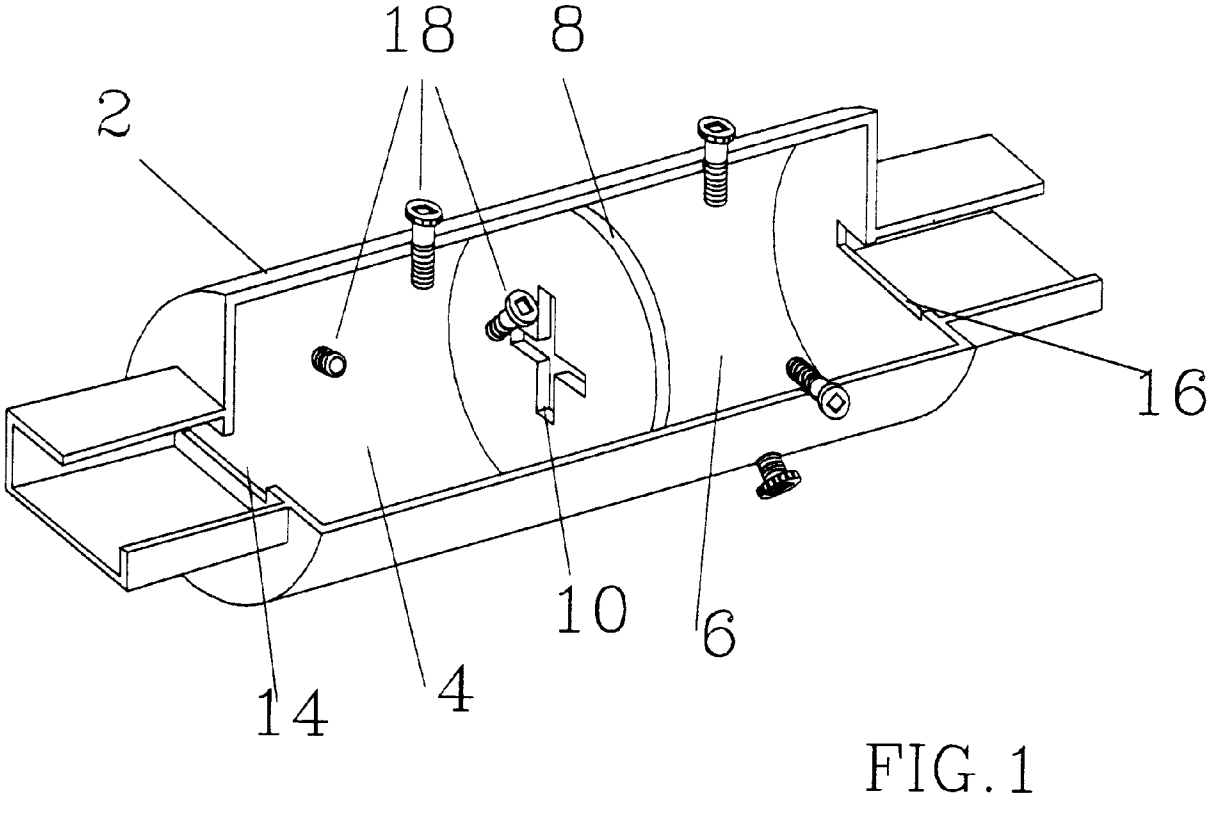
FIG. 1
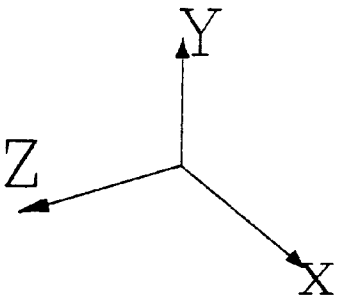

CIRCULAR WAVEGUIDE CAVITY AND FILTER HAVING AN IRIS WITH AN ECCENTRIC CIRCULAR APERTURE AND A METHOD OF CONSTRUCTION THEREOF

BACKGROUND OF THE INVENTION

1. Field of the Invention

This invention relates to a cavity and filter containing said cavity and to a method of constructing said cavity with one or more irises containing eccentric circular apertures.

2. Description of the Prior Art

It is known to couple energy between cylindrically shaped cavities using a circular aperture located in a cross wall separating adjacent cavities. In FIGS. 2 and 2(*a*), (see U.S. Pat. No. 4,652,844, naming Brambilla as inventor), there is described, as prior art, two cavities separated by a cross wall Pti, which contains a centrally located circular opening Ai. The Brambilla Patent describes an arcuate aperture for use in conjuntion with an adjusting screw for coupling between adjacent cavities.

U.S. Pat. No. 4,030,051, naming Shimizu et al as inventor, describes a microwave resonator having a rotary joint for variable coupling between cavities. The rotary joint is located at the midpoint of a cavity and apertures, having an elliptical shape, are centered in an iris plate. The patent states that coupling into and out of the cavity may be accurately varied simply by rotating the portion of waveguide on opposite sides of the rotating joint relative to one another.

A prior art cylindrical cavity structure is shown in FIG. 1 where a filter 2 has two cavities 4,6 separated by an iris 8 having a centrally located cruciform aperture 10. The filter has an input 14 and an output 16 and each cavity has 3 tuning screws 18 to provide the desired coupling and phase balance. The arrangement of the tuning screws is shown in FIG. 2(*a*), which represents a prior art schematic end view of the tuning screws 18 in one of the cavities 6. From FIG. 1, it can be seen that the tuning screws 18 in the cavity 4 are oriented in a different arrangement than the arrangement of the tuning screws 18 in cavity 6.

In another prior art embodiment shown in FIG. 2(*b*), the tuning screws 18 are replaced by short rectangular posts 20 in cavity 6 (see Guglielmi et al, "Dual-mode Circular Waveguide Filters Without Tuning Screws", IEEE, Microwave Guided Wave Lett., VOL. 2, pages 457 to 458, Nov. 1992 and Beyer et al, "Efficient Modal Analysis of Waveguide Filters Including The Orthoginal Mode Coupling Elements by a MM/FE Method", IEEE Microwave Guided Wave Lett., VOL. 5, Jan. 1995). It should be noted that the rectangular posts vary in size from one another. The structure is analyzed using a pure numerical Finite Element Method (FEM) analysis. Rectangular posts 22 shown in cavity 6 in prior art FIG. 2(*c*) have been modified to make the analysis easier (see Vahldieck, "A Combined Mode Matching/Method of Lines Approach For Field-theory Analysis Of Dual Mode Filters", Proceedings of ESA Workshop in Advanced CAD for Microwave Filters and Passive Devices, pages 1 to 15, Nov. 1995).

In Accatino et al., "A Four-pole Dual Mode Eliptic Filter Realized in Circular Cavity Without Screws", IEEE Trans. Microwave Theory Tech., VOL. MTT-44, pages 2680–2687, Dec. 1996, as shown in FIG. 2(*d*), the cavity 6 has an iris 24 having a rectangular aperture 26. The iris is located in the middle of the resonant cavities and coupling and tuning mechanisms are obtained by rotation angle of the rectangular aperture and by size of the rectangular aperture relative to the size and thickness of the iris sections. The prior art arrangement shown in FIG. 2(*d*) has several advantages over previous structures. Unfortunately, the structure shown in FIG. 2(*d*) suffers from disadvantages as well. For example, in order to construct the irises containing the rectangular apertures, sophisticated mechanical processes are required, for example, electro-discharge machining to ensure that the corners of the rectanglar aperture are sharp. Further, the minimum ratio of remaining conductor surface area over the cavity cross section is as large as $(\pi-2)/\pi$. This results in the conductor loss on the remaining surface being large, which in turn decreases the unloaded Q of the filter. An iris of a small aperture in a $TE_{11n}$ mode circular cavity may increase a risk of having spurious modes in the frequency band of interest. FIG. 2(*e*) describes a cavity 6 having an iris 27 with elliptical aperture 29.

SUMMARY OF THE INVENTION

It is the object of the present invention to provide a waveguide cavity structure which can be constructed more simply and designed more effectively than previous structures with improved electrical performance in terms of spurious mode behaviour and unloaded Q value. It is a further object of the present invention to provide a waveguide cavity structure where each cavity contains one or more irises having an eccentric circular aperture that extends beyond a centre of the iris in which the aperture is located.

The microwave circular waveguide cavity has at least two modes resonating simultaneously in said cavity. The cavity contains a circular iris mounted transversely therein. The iris has an eccentrically located circular aperture, said aperture being sized and located to control coupling between modes resonating within said at least one cavity. The aperture is sized to extend beyond a center of said iris.

A microwave circular waveguide filter has at least one cylindrical cavity resonating at its resonant frequency in at least two modes simultaneously. At least one cavity contains a circular iris, said iris being mounted transversely therein. The iris has an eccentrically located circular aperture, the aperture being sized and located to control coupling between modes resonating within said at least one cavity. The aperture is sized to extend beyond a center of said iris.

A method of constructing a microwave circular wave guide cavity having at least two modes resonating simultaneously in said cavity, said cavity containing a circular iris mounted transversely therein, said iris having an eccentrically located circular aperture, said method comprising sizing and locating said aperture to control coupling between said at least two modes within said cavity by choosing a radius for said aperture that will extend said aperture beyond a center of said iris, choosing an offset distance for a center of said aperture from a center of said iris, choosing an inclination angle for said iris, choosing a thickness for said iris and choosing a location within said cavity for said iris to control such coupling.

BRIEF DESCRIPTION OF THE DRAWINGS

FIG. 1 shows a prior art partially cut away perspective view of a dual mode filter having two cavities;

FIG. 2(*b*) is a prior art schematic end view of a cavity containing posts;

FIG. 2(*c*) is a prior art schematic end view of a cavity containing a further embodiment of posts;

FIG. 2(*d*) is a prior art schematic end view of a cavity containing an iris having a rectangular aperture;

FIG. 2(*e*) is a prior art schematic end view of a cavity containing an iris having an elliptical aperture;

FIG. 2(*f*) is a schematic end view of a cavity containing an iris having an eccentric circular aperture;

DESCRIPTION OF A PREFERRED EMBODIMENT

Definitions:

EIGEN MODES OF A WAVEGUIDE: All the possible electromagnetic field distributions over a waveguide cross section satisfying the boundary conditions and Maxwell's equations. There are only a few kinds of waveguide cross sections whose eigen modes are analytically available. Among these, rectangular waveguide, circular waveguide and elliptic waveguide are the most often used.

ELECTROMAGNETIC MODAL ANALYSIS (ALSO CALLED MODE MATCHING METHOD): A rigorous analysis suitable for a large class of electromagnetic problems, particularly, waveguide problems. It uses the eigen modes in each of the waveguide sections and matches the field continuity boundary conditions on the common boundaries of different waveguides. It is considered the most accurate and efficient algorithm for waveguide problems.

DUAL MODE CAVITY: Theoretically speaking, there may be more than one resonant mode existing in a circular cavity. Due to the symmetrical property of the circular waveguide, the resonant modes appear by pairs. In each pair of modes, one mode is perpendicular to another in space and the two modes have the same resonant frequency. By using this property, one physical circular cavity is equivalent to two electrical resonant cavities. The dual mode cavity is such a cavity with an appropriate coupling mechanism of the two modes.

Figure 2:
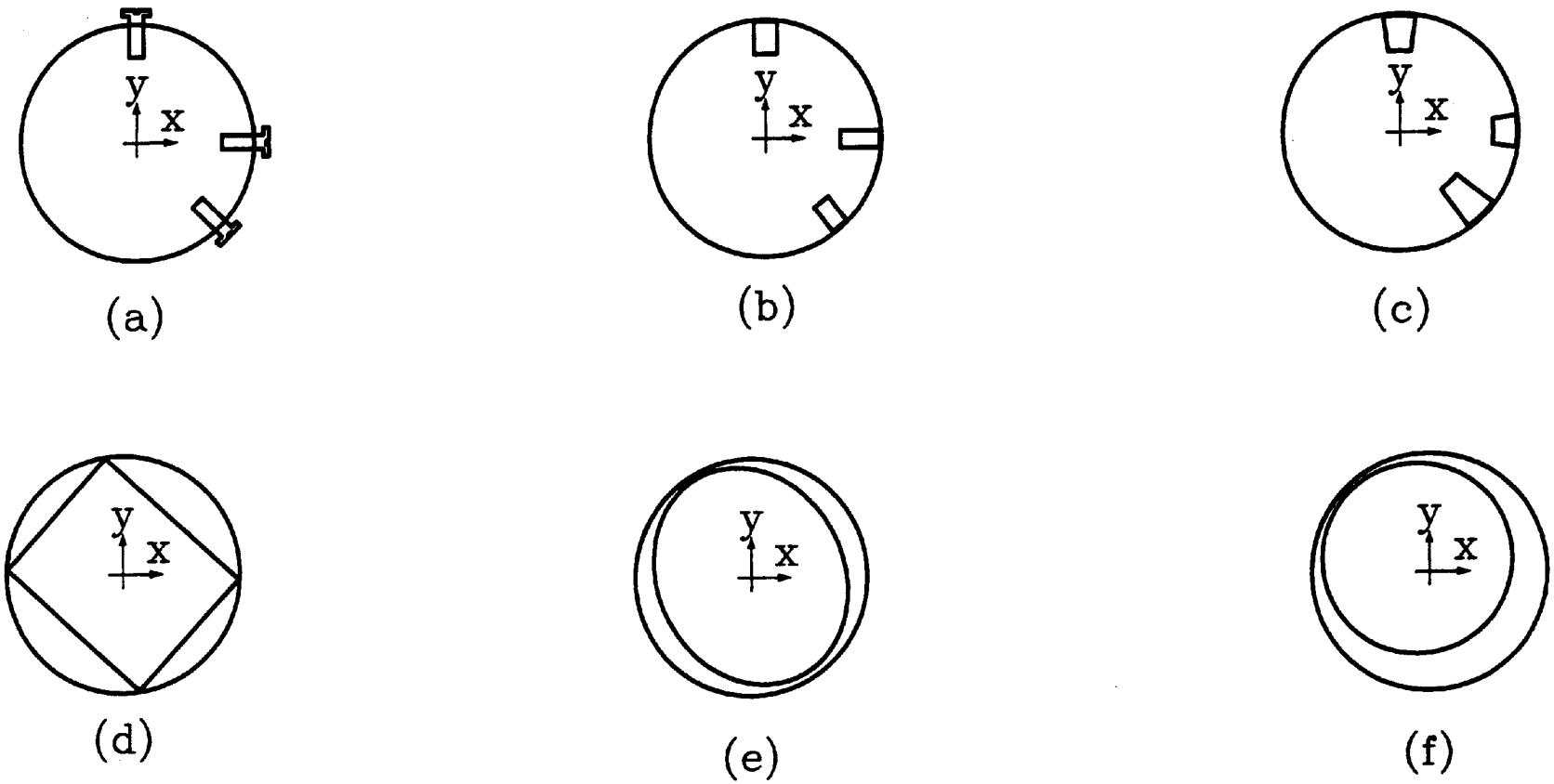
FIG. 2(*a*) is a prior art schematic end view showing an arrangement of tuning screws within a cavity.
Figure 3:
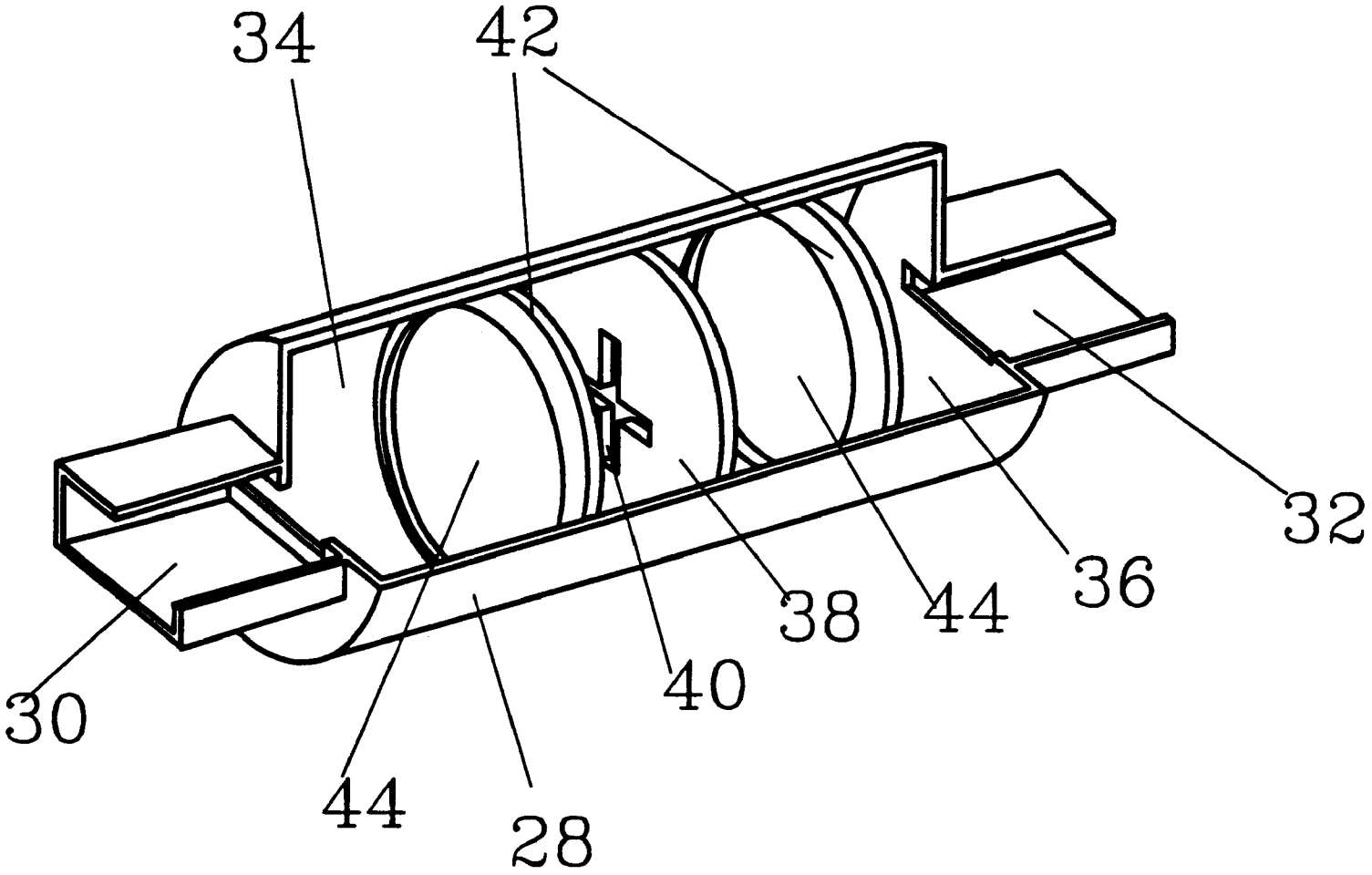
FIG. 3 is a cut-away perspective view of a dual mode filter having two cavities, with each cavity containing a circular iris containing an eccentric circular aperture.

In FIG. 3, there is shown a dual mode filter 28 having an input 30 and an output 32 with two cylindrically shaped cavities 34,36. The cavities 34,36 are separated by a conventional iris 38 having a cruciform aperture 40. The aperture 40 could have another conventional shape other than cruciform. Within each cavity 34,36 is an iris 42 containing an eccentric circular aperture 44. The irises 42 are located at a longitudinal center within each of the cavities 34,36. While the irises are preferably located at the longitudinal center for a dual mode filter, the filter will operate satisfactorily as long as the irises are located near the longitudinal center to control dual mode coupling within each cavity. The irises 42 are mounted transversely to a longitudinal axis of each cavity. The coupling can be controlled by the location of the iris along the length of the cavity as well as a radius of the eccentric aperture, an amount of a center offset, an inclination of the iris and the thickness of the iris. The filter can be constructed with the irises 42 built into the cavity as an integral part thereof in order to minimize losses. The integrated cavity can be machined easily with conventional milling machines. A schematic end view of the cavity 36 is shown in FIG. 2(*f*). The cavity 36 contains the iris 42 with the eccentric circular aperture 44.

Figure 4:
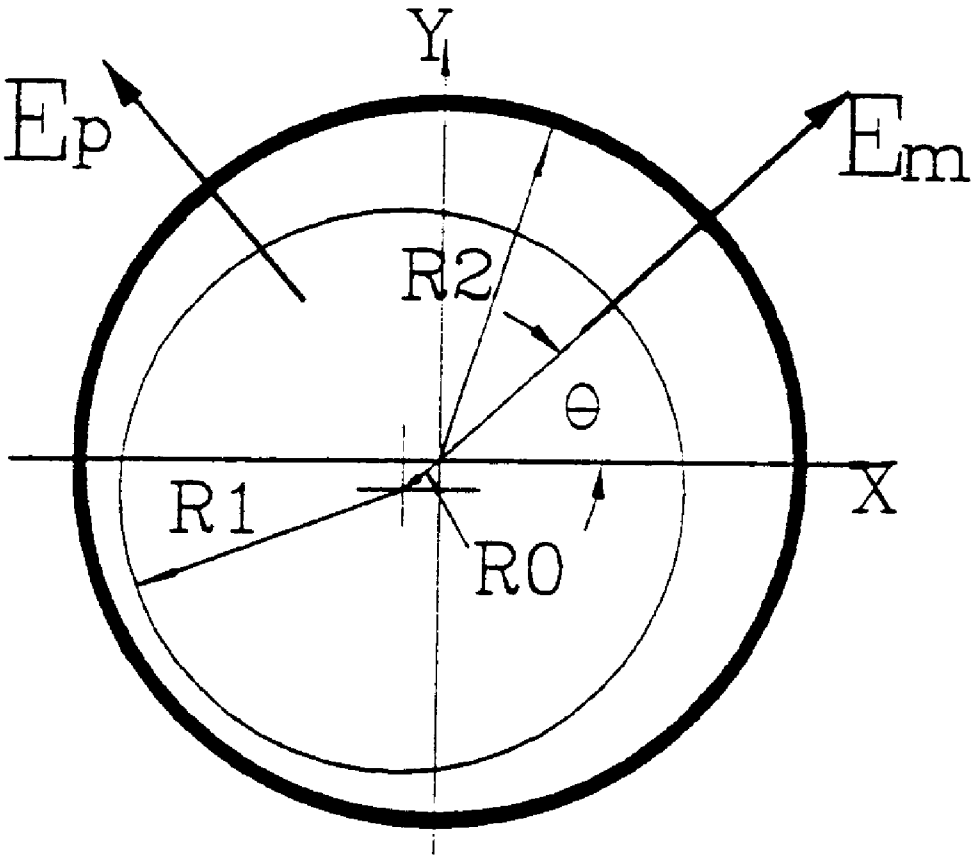
FIG. 4 is a schematic end view of a circular iris within a circular cavity, said iris containing an eccentric circular aperture that extends beyond a center of said iris.

In FIG. 4, there is shown a schematic end view of the circular iris 42 within the cavity 34. The iris 42 contains the circular eccentric aperture 44.

The iris 42 has a radius $R_2$. The eccentric circular aperture 44 has a radius $R_1$. An x-axis corresponds to a wide side of the input 30. The input 30 is an input waveguide.

A y-axis is perpendicular to the x-axis. An imaginary line $R_0$ extending between the center of the said iris 42 and centre of said aperture 44 forms an angle θ with the x-axis. For dual mode cavities, the angle is not equal to 0° and is not equal to 90°. With dual mode cavities, when θ is equal to 0° or 90°, there is no coupling. When the angle θ is at or near 45°, the maximum coupling should occur. For triple mode cavities, the angle θ is approximately equal to 90°. The angle θ is the inclination angle of the iris.

In FIG. 4, two principal symmetry planes are defined with the inclination angle θ with respect to the horizontal axis. It can be mathematically proven that for the two degenerate modes having a polarization plane parallel to the x-axis and y-axis of the waveguide resonant cavity, the coupling value between the two modes is proportional to $\cos(\theta)\cdot\sin(\theta)\cdot(S_m - S_p)$, where $S_m$ and $S_p$ are the scattering parameters of a circular cavity with an off-centered circular iris parallel to the inclination axis (field component $E_m$) and perpendicular to the axis(field component $E_p$), respectively. From the above mentioned relationship, the following conclusions can be drawn:

(1) Adjusting the inclination angle varies the coupling value. As a special case, there is no coupling when θ=0° or θ=90°. On the other hand, the maximum coupling should occur near θ=45°;

(2) When the offset displacement is zero, $S_m = S_p$. Therefore, there is no coupling between the two modes;

(3) Reducing the radius of the iris aperture increases the difference between $S_m$ and $S_p$. Consequently, the coupling increases between the two modes; and (4) The thickness of the iris affects $S_m$ and $S_p$ and consequently the coupling value.

The iris plate can be equivalent to an impedance inverter, which couples energy from one mode to another. The impedance inverter can be described using an equivalent T circuit with a shunt reactance Xp and a series reactance Xs on each arm. The value of the shunt reactance Xp and the series reactance Xs are calculated using the following formulation derived intuitively:

$$jX_s = \frac{1 - S_{12} + S_{11}}{1 - S_{11} + S_{12}};$$

$$jX_p = \frac{2S_{12}}{(1 - S_{11})^2 + (S_{12})^2};$$

where $S_{12}$ and $S_{11}$ are the transmission and reflection coefficients respectively.

Figure 5:
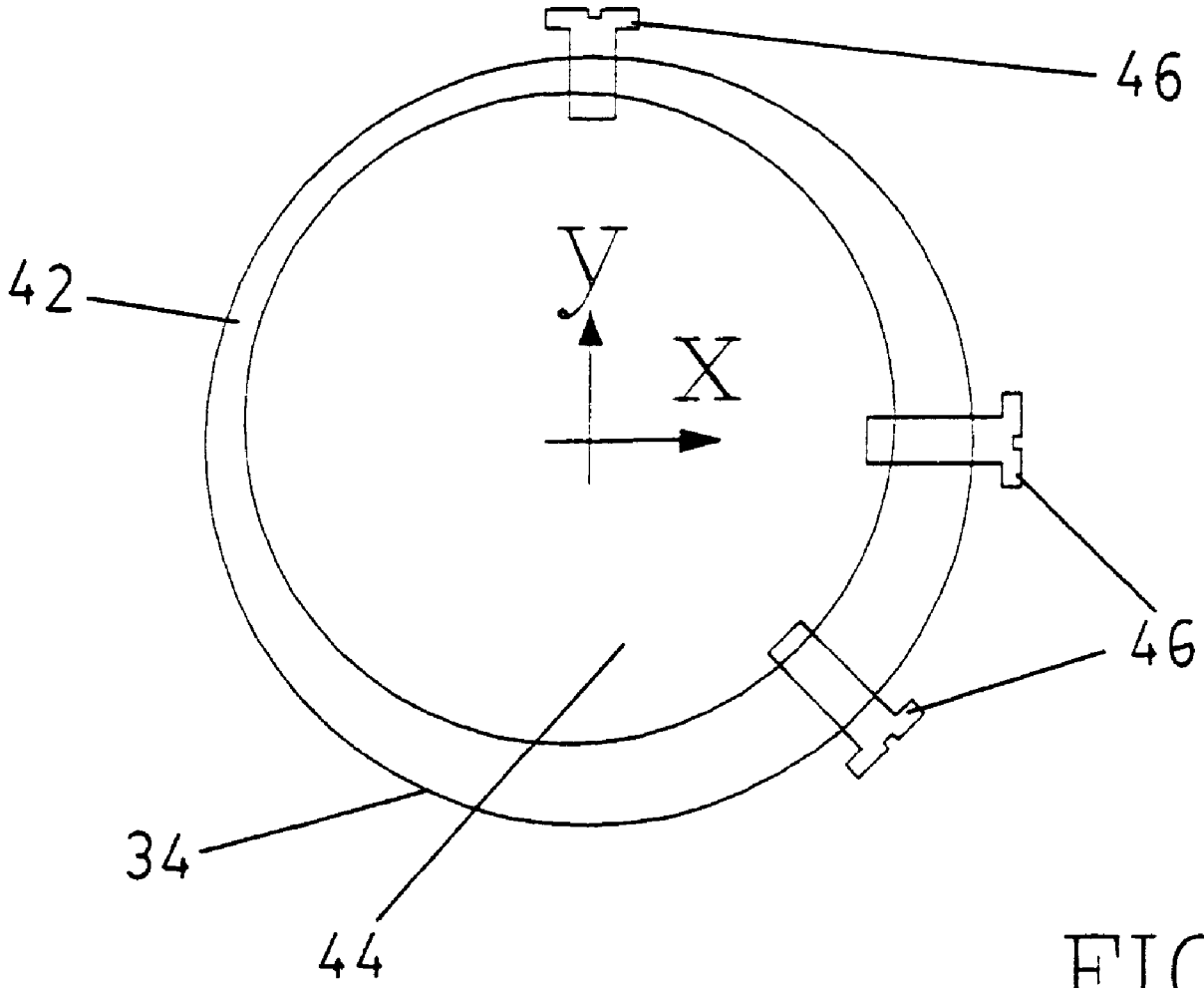
FIG. 5 is a schematic end view of a circular iris within a circular cavity, said cavity containing tuning screws.

FIG. 5 shows a schematic end view end view of the circular iris 42 within the cavity 34. The iris 42 contains the circular eccentric aperture 44. The cavity 34 has three tuning screws 46 for fine tuning the cavity.

Figure 6:
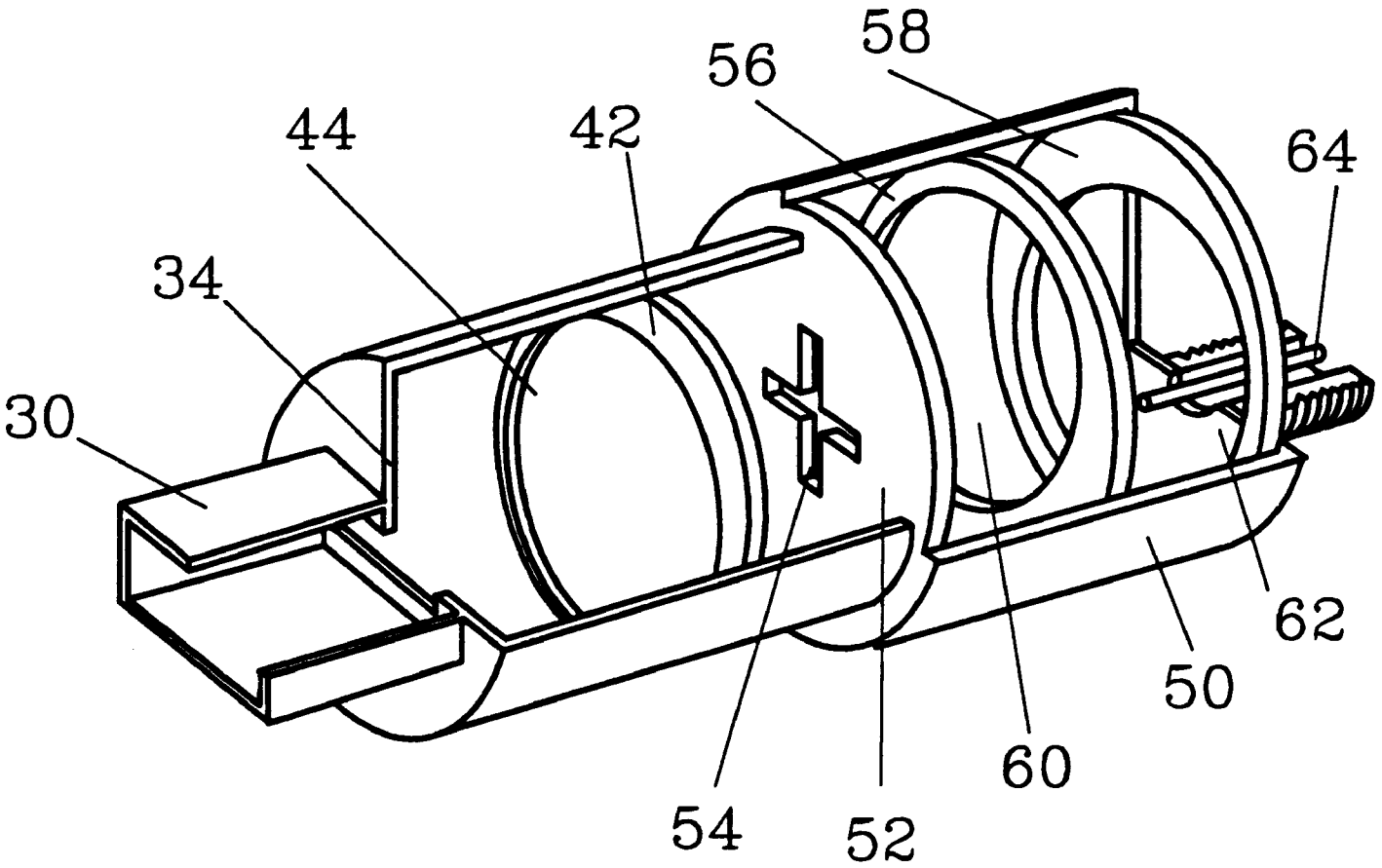
FIG. 6 is a cut-away perspective view of a filter having one dual mode cavity and one triple mode cavity.

FIG. 6 shows a filter 48 having two cavities 34, 50 separated by an iris 52 having a cruciform aperture 54. The cavity 34 is a dual mode cavity having an iris 42 with an eccentric circular aperture 44. The cavity 34 resonates in two modes simultaneously. The cavity 50 is a triple mode cavity and resonates in three modes simultaneously. The cavity 50 contains two irises 56, 58 having circular apertures 60, 62 respectively. The iris 56 is located at approximately a mid-point of the cavity 50 and the iris 58 is located near or at an end of the cavity 50 opposite to the iris 52. The filter 48 has an input 30 and an output 64, the output 64 being a probe. The same reference numbers have been used in FIG. 6 as those used in FIG. 3 to describe those components that are identical.

Figure 7:
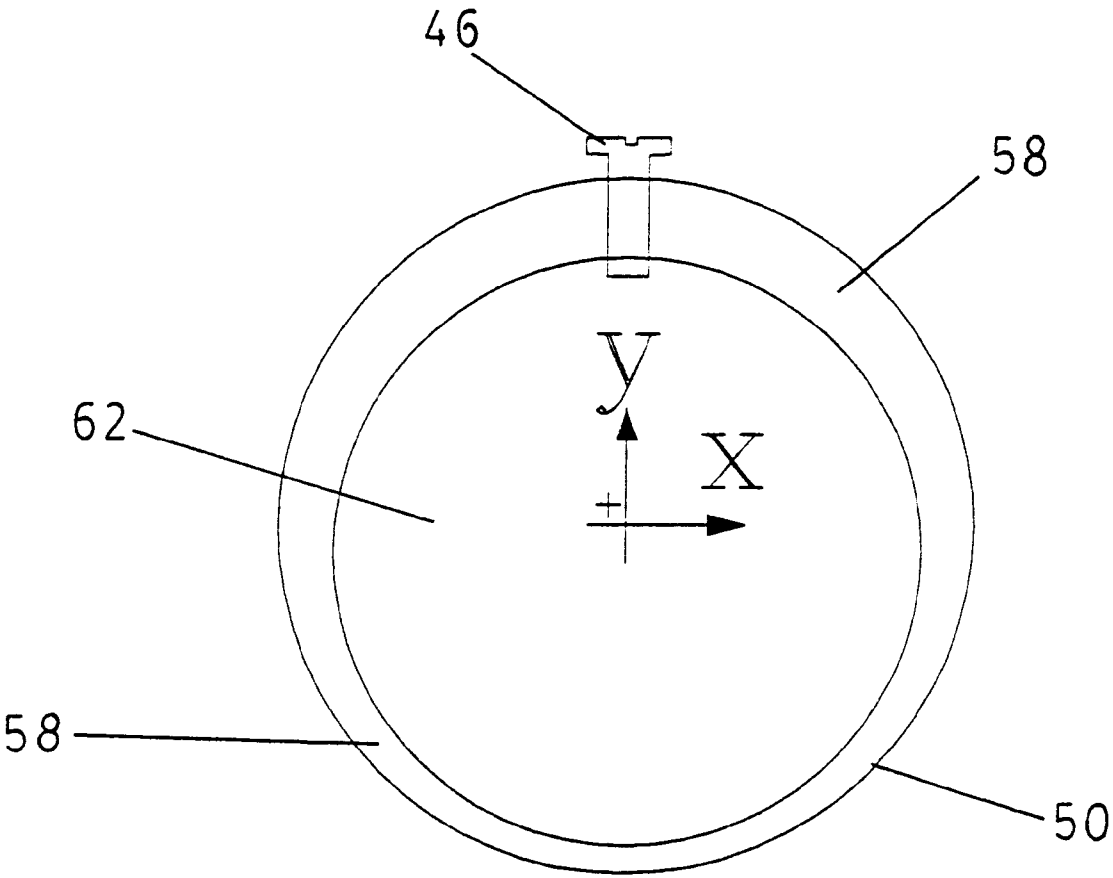
FIG. 7 is a schematic end view of the filter of FIG. 6 with a tuning screw added to one of the cavities.

FIG. 7 describes a schematic end view of the cavity 50 of FIG. 6 with a tuning screw 46 added for fine tuning. The cavity 50 contains the iris 58 with the circular aperture 62. More than one tuning screw would be added to the cavity 50. Also, tuning screws could be added to the cavity 34.

Other filters could be designed with more than one triple mode cavity or with one or more dual mode cavities in combination with single or triple mode cavities.

For triple mode cavities and triple mode filters, there is one iris containing an eccentric aperture located near the longitudinal center of the cavity and another iris containing an eccentric aperture near an end of the cavity. The present invention is not limited to filters but can be used to other structures having cylindrical cavities. Also, dual mode cavities using the eccentric aperture can be combined with single mode cavities or triple mode cavities to form a waveguide structure. As an example, a four-pole, two cavity filter has been constructed having a 36 Mhz bandwidth with a center frequency of 12,600 Mhz. The measured unloaded Q of this filter is in the range of 14,000 to 15,000 with no tuning screws. The spurious mode performance is similar to that of a conventional structure having tuning screws. In some applications, it might be desirable to use the eccentric irises of the present invention together with tuning screws that can be used for fine tuning the waveguide structure.

Preferably, the size of the eccentric circular aperture is substantial compared to a size of the iris in which the aperture is located.

It should be understood that the materials and processes used to fabricate the various embodiments of the invention are not critical and that any material process exhibiting similar desired characteristics and structures may be utilized. Although the present invention has been shown and described with reference to particular dual mode and triple mode filter cavities, nevertheless various changes, modifications and additional embodiments, within the scope of the attached claims, will be obvious to those persons skilled in the art to which this invention pertains.

I claim:

1. A microwave circular waveguide cavity comprising at least two modes resonating simultaneously in said cavity, said cavity containing a circular iris mounted transversely therein, said iris having an eccentrically located circular aperture, said aperture being sized and located to control coupling within said cavity between said at least two modes, said aperture being sized to extend beyond a center of said iris.

2. A cavity as claimed in claim 1 wherein the cavity is a dual mode cavity and the iris is located near a longitudinal center of said cavity.

3. A cavity as claimed in claim 2 wherein the iris is centrally located along a length of said cavity.

4. A cavity as claimed in claim 1 wherein said cavity is a triple mode cavity and said cavity contains two irises, one iris being located near one end of said cavity and another iris being located near a longitudinal center of said cavity, each iris having an eccentrically located circular aperture.

5. A cavity as claimed in claim 4 wherein one of said irises is centrally located along a length of said cavity and another of said irises is located at an end of said cavity.

6. A cavity as claimed in claim 1 wherein there is more than one iris located within said cavity, each iris containing an eccentrically located circular aperture.

7. A cavity as claimed in any one of claims 1, 2 or 4 wherein said cavity has tuning screws.

8. A cavity as claimed in claim 1 wherein said cavity is a dual-mode cavity that resonates at its resonant frequency in two modes simultaneously, said cavity having an x-axis, said x-axis corresponding to a wide side of an input waveguide, an imaginary line extending between a center of said iris and a center of said aperture, said line forming an angle with said x-axis that is not equal to 0° and is not equal to 90°.

9. A cavity as claimed in claim 5 wherein said cavity is a triple mode cavity, said cavity resonating at its resonant frequency in at least three modes simultaneously, said cavity having an x-axis corresponding to a wide side of an input waveguide, said cavity having an imaginary line extending between a center of said iris and a center of said aperture, said imaginary line forming an angle that is equal to approximately 90° with said x-axis.

10. A cavity as claimed in any one of claims 1, 2 or 4 wherein said aperture for a size that is greater than 50% of a size of said iris in which said aperture is located.

11. A microwave circular waveguide filter comprising at least one cylindrical cavity resonating at its resonant frequency in at least two modes simultaneously, said at least one cavity containing a circular iris, said iris being mounted transversely therein, said iris having an eccentrically located circular aperture, said aperture being sized and located to control coupling within said at least one cavity between modes resonating within said at least one cavity.

12. A filter as claimed in claim 11 wherein said at least one cavity is a dual-mode cavity and said iris is located near a longitudinal center of said cavity, said aperture being sized to extend beyond a centre of said iris.

13. A filter as claimed in claim 12 wherein the filter is a dual mode filter and the iris is centrally located along a length of said at least one cavity.

14. A filter as claimed in claim 11 wherein said at least one cavity is a triple mode cavity, said at least one cavity containing two irises, one iris being located near one end of said at least one cavity and another iris being located near a longitudinal center of said at least one cavity, each iris having an eccentrically located circular aperture.

15. A filter as claimed in claim 14 wherein said filter is a triple mode filter and one of said irises is located at an end of said at least one cavity and another of said irises is centrally located along a length of said at least one cavity.

16. A filter as claimed in claim 11 wherein there is more than one iris located within said filter, each iris containing an eccentrically located circular aperture.

17. A filter as claimed in claim 11 wherein said filter has tuning screws.

18. A filter as claimed in any one of claims 11, 12 or 14 wherein there are at least two cavities, each cavity containing an iris having an eccentrically located aperture therein, there being an additional iris between said at least two cavities, said additional iris also containing a conventional aperture selected from the group of cruciform, oblong and arc-shaped, said additional iris controlling coupling between said two cavities.

19. A filter as claimed in claim 12, said filter having input waveguide, each cavity having an x-axis corresponding to a wide side of said input waveguide, an imaginary line extending between a center of said iris and a center of said aperture, said line forming an angle with said x-axis that is not equal to 0° and not equal to 90°.

20. A filter as claimed in claim 14 wherein said filter has an input waveguide and an output coaxial probe at the end of the at least one triple mode cavity, said cavity having an x-axis corresponding to a wide side of said input waveguide, each iris of said cavity having an imaginary line extending from a center of each iris to a center of a corresponding aperture of each iris, each imaginary line having an angle relative to said x-axis that is equal to 90° for one of said irises.

21. A method of constructing a microwave circular waveguide resonant cavity having at least two modes resonating simultaneously in said cavity, said cavity containing a circular iris mounted transversely therein, said iris having an eccentrically located circular aperture, said method comprising sizing and locating said aperture to control coupling within said cavity between said at least two modes, choosing a radius for said aperture that will extend said aperture beyond a center of said iris, choosing an offset distance for a center of said aperture from a center of said iris, choosing an inclination angle for said iris, choosing a thickness for said iris and choosing a location within said cavity for said iris to control coupling.

22. A method as claimed in claim 21 wherein said cavity has tuning screws, said method including the step of adjusting said tuning screws to fine tune said modes.

23. A method as Claimed in claim 22 wherein said cavity is a dual-mode cavity and said aperture is designed in accordance with the following formulae:

$$jX_s = \frac{1 - S_{12} + S_{11}}{1 - S_{11} + S_{12}};$$

$$jX_p = \frac{2S_{12}}{(1 - S_{11})^2 + (S_{12})^2};$$

where $S_{12}$ and $S_{11}$ are the transmission and reflection coefficients respectively.

* * * * *